US008013830B2

(12) United States Patent
Hsu et al.

(10) Patent No.: US 8,013,830 B2
(45) Date of Patent: Sep. 6, 2011

(54) LIQUID CRYSTAL DISPLAY AND DRIVING METHOD THEREOF

(75) Inventors: Chih-Che Hsu, Taipei (TW); Li-Ru Lyu, Hsinchu (TW)

(73) Assignee: AU Optronics Corp., Hsin-Chu (TW)

( * ) Notice: Subject to any disclaimer, the term of this patent is extended or adjusted under 35 U.S.C. 154(b) by 971 days.

(21) Appl. No.: 11/443,092

(22) Filed: May 31, 2006

(65) Prior Publication Data

US 2007/0176883 A1 Aug. 2, 2007

(30) Foreign Application Priority Data

Jan. 27, 2006 (TW) ..... 95103589 A

(51) Int. Cl.
*G09G 3/36* (2006.01)

(52) U.S. Cl. ..... 345/102; 349/62

(58) Field of Classification Search ..... 345/102
See application file for complete search history.

(56) References Cited

U.S. PATENT DOCUMENTS 5,488,571 A * 1/1996 Jacobs et al. ..... 708/111
6,448,951 B1 * 9/2002 Sakaguchi et al. ..... 345/88
6,501,234 B2 12/2002 Lin et al.
6,707,264 B2 3/2004 Lin et al.
6,812,916 B2 * 11/2004 Hwang ..... 345/102
6,816,142 B2 11/2004 Oda et al.
7,312,782 B2 * 12/2007 Hiraki et al. ..... 345/102
2003/0178951 A1 9/2003 Park et al.
2004/0251808 A1 * 12/2004 Hsu et al. ..... 313/485
2005/0127847 A1 6/2005 Lin
2005/0179359 A1 * 8/2005 Fran et al. ..... 313/495
2005/0248524 A1 * 11/2005 Feng et al. ..... 345/102
2006/0103330 A1 * 5/2006 Hsu ..... 315/291

FOREIGN PATENT DOCUMENTS

CN 1693952 A 11/2005
TW 1229573-8 3/2006

* cited by examiner

*Primary Examiner* — Alexander Eisen
*Assistant Examiner* — Robin Mishler
(74) *Attorney, Agent, or Firm* — Birch, Stewart, Kolasch & Birch, LLP

(57) ABSTRACT

A liquid crystal display and a driving method thereof. The liquid crystal display includes a liquid crystal display panel, a backlight module, a dimming control unit and a backlight module driving circuit. The liquid crystal display panel has a first display area and a second display area. The backlight module includes a plurality of lighting devices respectively corresponding to pixels in the first display area and the second display area. The dimming control unit generates at least one dimming control signal having a dimming frequency which is a multiple of a frame rate of the liquid crystal display panel. The backlight module driving circuit periodically drives the lighting devices in sequence according to the dimming control signal.

19 Claims, 8 Drawing Sheets

LIQUID CRYSTAL DISPLAY AND DRIVING METHOD THEREOF

This application claims the benefit of Taiwan application Serial No. 95103589, filed Jan. 27, 2006, the subject matter of which is incorporated herein by reference.

BACKGROUND OF THE INVENTION

1. Field of the Invention

The invention relates in general to a liquid crystal display and a driving method thereof, and more particularly to a liquid crystal display of improving a frame flicker phenomenon, and a driving method thereof.

2. Description of the Related Art

In order to make the liquid crystal display possess a better image quality, a backlight module for controlling on and off of a lighting device to reduce the frame retained image and enhance the motion picture quality has been disclosed.

The dimming methods for the backlight module may be divided into an analog dimming method and a burst dimming method.

FIG. 1 shows a waveform of an output voltage for changing the luminance of a lamp by way of analog dimming. The analog dimming utilizes a control inverter to drive the amplitude $V_p$ of the output voltage of the lamp to change the luminance of the lamp. When the amplitude $V_p$ of the output voltage becomes larger, the luminance of the impulse type backlight module increases. Inversely, when the amplitude $V_p$ of the output voltage becomes smaller, the luminance of the impulse type backlight module decreases.

Because the current liquid crystal display is developed toward the trend of large-scale specification, the uniformity of the impulse type backlight module deteriorates due to the leakage current if the impulse type backlight module adopts the analog dimming method. Thus, the analog dimming only can reach the 70% to 100% of the luminance dimming range.

FIG. 2 shows a waveform of a dimming control signal for changing the luminance of a lamp by way of burst dimming. In order to enlarge the range of luminance dimming, most of the current impulse type backlight modules utilize the burst dimming method. The burst dimming is also referred to as the digital dimming or the pulse width modulation dimming (PWM Dimming), in which the luminance of the lamp is changed as a duty cycle $T_{Duty}$ of the dimming control signal is changed. When the duty cycle $T_{Duty}$ of the dimming control signal becomes larger, the luminance of the impulse type backlight module increases. Inversely, when the duty cycle $T_{Duty}$ of the dimming control signal becomes smaller, the luminance of the impulse type backlight module decreases. Compared to the analog dimming method, the range of the burst dimming method can reach 30% to 100% of luminance.

However, the frame luminance sensed by the human eyes depends on the dimming frequency of the flicker type backlight module and the frame rate of the liquid crystal display panel. When the dimming frequency interacts with the frame rate to form a new flicker frequency falling within the range that can be sensed by the human eyes, the frame flicker phenomenon is formed on the liquid crystal display panel, and the human eyes may feel uncomfortable.

FIG. 3 shows a waveform measured in a conventional liquid crystal display using the burst dimming. For example, when the dimming frequency (i.e., the backlight frequency) is 208 Hz and the frame rate is 60 Hz, a serious frame flicker phenomenon is formed at 31 to 36 Hz of FIG. 3.

FIG. 4 is a schematic illustration showing a conventional liquid crystal display. In addition, because a scan driver 460 of a conventional liquid crystal display 40 sequentially outputs scan signals $S_{scan}(1)$ to $S_{scan}(m)$ to drive each row of pixels on a liquid crystal display panel 410, as shown in FIG. 4, the orientations of the liquid crystal molecules of the pixels in different display areas are influenced due to the different timings of the scan signals. Thus, the pixels in different display areas do not reach the maximum transmission at the same time, and the liquid crystal response curves in different display areas differ from each other by a liquid crystal delay phase.

FIG. 5 shows liquid crystal response curves of a liquid crystal display in different horizontal display areas. Row "a" of pixels, row "b" of pixels, row "c" of pixels and row "d" of pixels on the liquid crystal display panel 410 are located in different horizontal display areas, and the transmissions of row "a" of pixels, row "b" of pixels, row "c" of pixels and row "d" of pixels form liquid crystal response curves LC(a) to LC(d) with the time. The liquid crystal delay phase exists between adjacent two of the liquid crystal response curves LC(a) to LC(d), and the liquid crystal delay phase substantially equals the delay time $t_d$. For example, row "a" of pixels in the liquid crystal response curve LC(a) reaches the maximum transmission at time t1, and row "b" of pixels in the liquid crystal response curve LC(b) reaches the maximum transmission at time t2. The liquid crystal delay phase between the liquid crystal response curve LC(a) and the liquid crystal response curve LC(b) equals the delay time $t_d$, and $t_d$=t2−t1.

Because the timings of the scan signals $S_{scan}(1)$ to $S_{scan}(m)$ are different from one another, the liquid crystal delay phases between adjacent two of the liquid crystal response curves LC(a) to LC(d) tend to make the human eyes feel that the color temperature of the frame of the liquid crystal display panel 410 is not uniform and the phenomenon of slow movement of the horizontal black band is thus formed.

SUMMARY OF THE INVENTION

It is therefore an object of the invention to provide a liquid crystal display of improving the frame flicker phenomenon, and a driving method thereof, wherein a dimming frequency of a dimming control signal is a multiple of a frame rate such that the frame flicker phenomenon is eliminated.

The invention achieves the above-identified object by providing a liquid crystal display including a liquid crystal display panel, a backlight module, a dimming control unit and a backlight module driving circuit. The liquid crystal display panel has a first display area and a second display area. The backlight module includes a plurality of lighting devices respectively corresponding to pixels in the first display area and the second display area. The dimming control unit generates at least one dimming control signal having a dimming frequency which is a multiple of a frame rate of the liquid crystal display panel. The backlight module driving circuit periodically drives the lighting devices in sequence according to the dimming control signal.

The invention also achieves the above-identified object by providing a driving method of a liquid crystal display. The liquid crystal display includes a liquid crystal display panel, a backlight module driving circuit and a backlight module. The liquid crystal display panel has a first display area and a second display area, and the backlight module includes a plurality of lighting devices. The driving method includes the steps of: utilizing a dimming control unit to output at least one dimming control signal having a dimming frequency which is a multiple of a frame rate of the liquid crystal display panel; adjusting a phase of the at least one dimming control signal to delay the at least one dimming control signal by a period of delay time, and then outputting the at least one delayed dimming control signal to the backlight module driving circuit; and utilizing the backlight module driving circuit to periodically drive the lighting devices in sequence according to the at least one delayed dimming control signal. The driven lighting devices correspond to pixels in the first display area or the second display area.

In the liquid crystal display and the driving method thereof, a dimming frequency of the dimming control signal is configured to be a multiple of the frame rate and the dimming control signal is delayed by a period of delay time and then outputted to the backlight module driving circuit. Thus, the frame flicker phenomenon of the liquid crystal display is eliminated, the phenomenon of slow movement of the horizontal black band is improved, and the frame quality of the liquid crystal display is enhanced.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
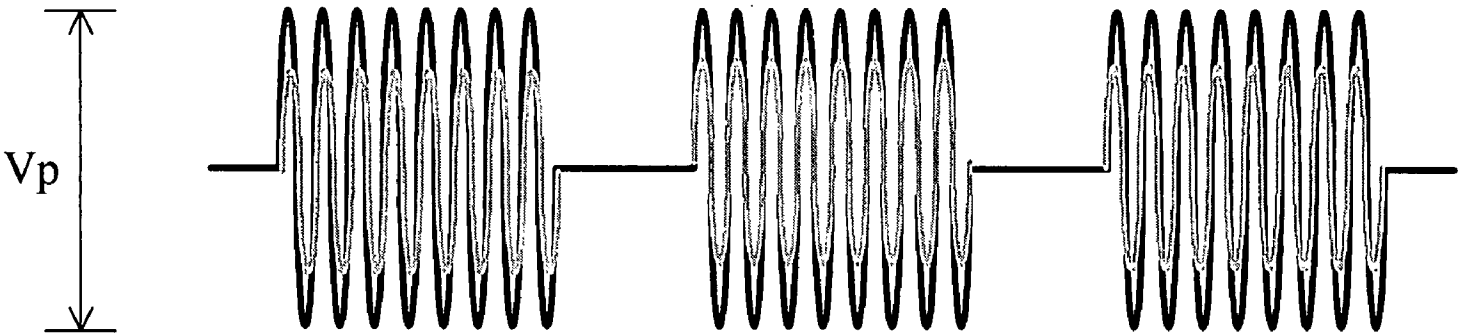
FIG. 1(RELATED ART)
FIG. 1 shows a waveform of an output voltage for changing the luminance of a lamp by way of analog dimming.
Figure 2:
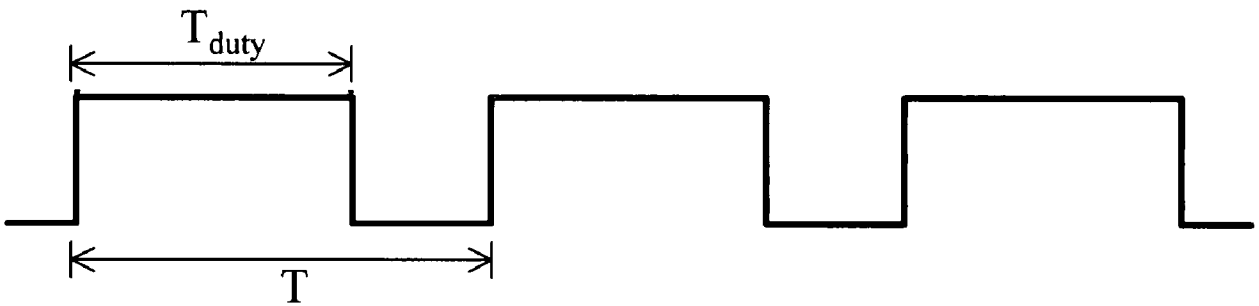
FIG. 2(RELATED ART)
FIG. 2 shows a waveform of a dimming control signal for changing the luminance of a lamp by way of burst dimming.
Figure 3:
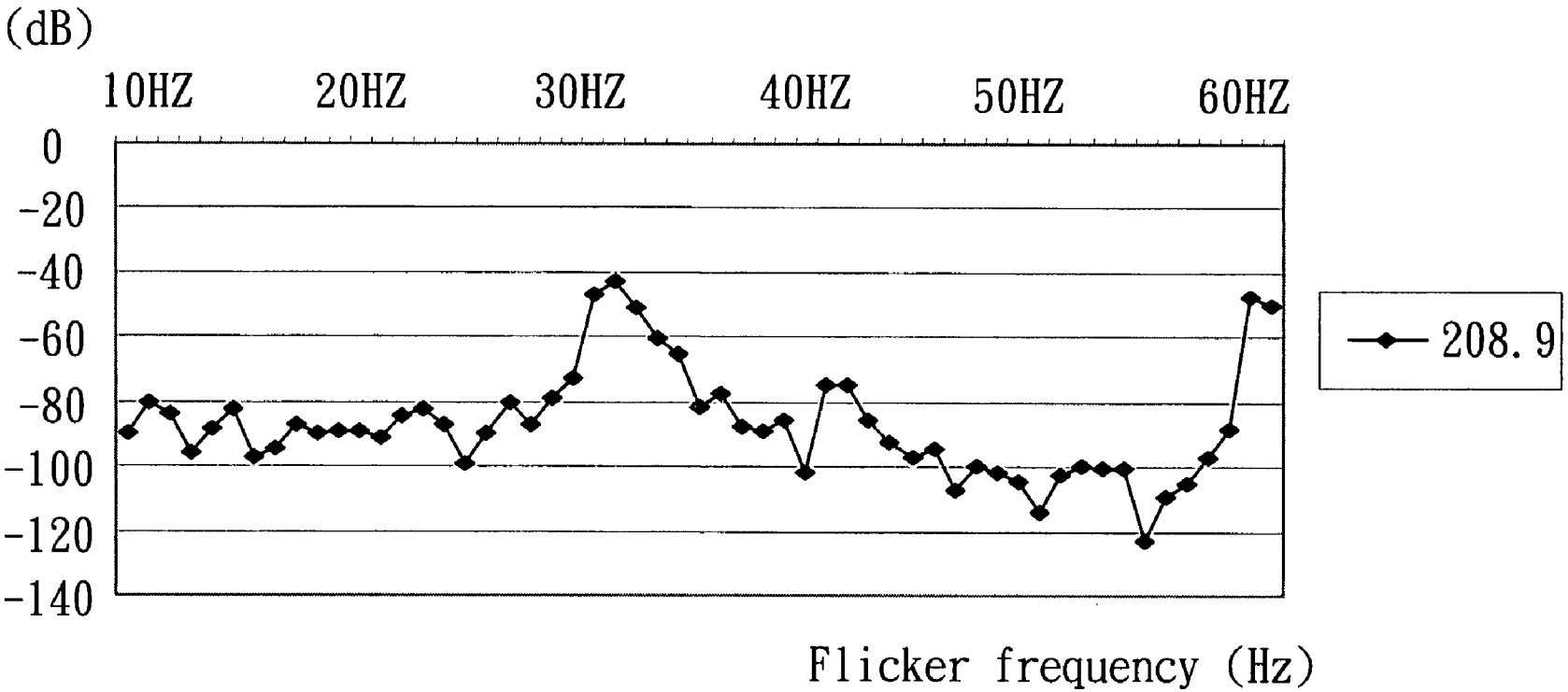
FIG. 3(RELATED ART)
FIG. 3 shows a waveform measured in a conventional liquid crystal display using the burst dimming.
Figure 4:
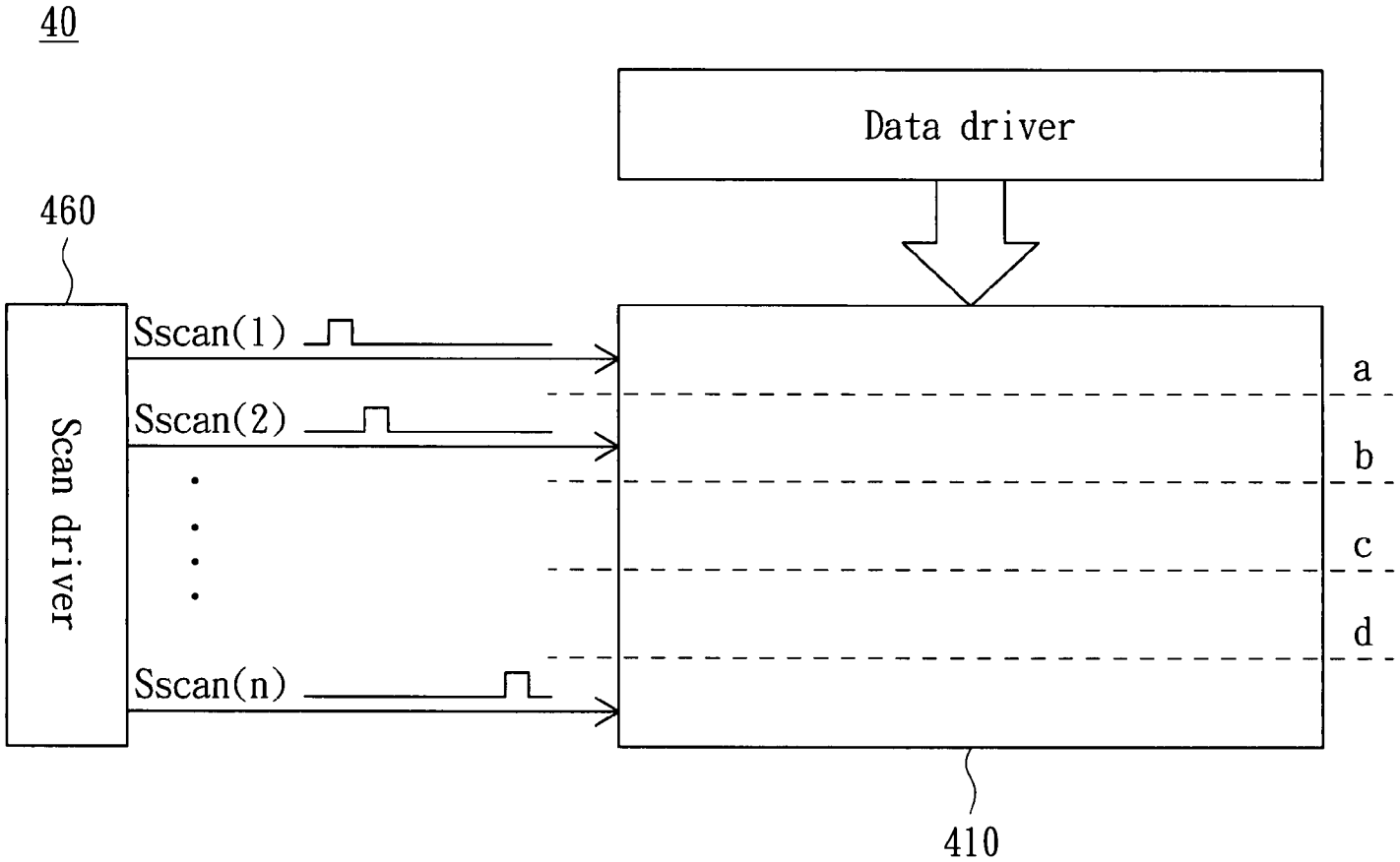
FIG. 4(RELATED ART)
FIG. 4 is a schematic illustration showing the conventional liquid crystal display.
Figure 5:
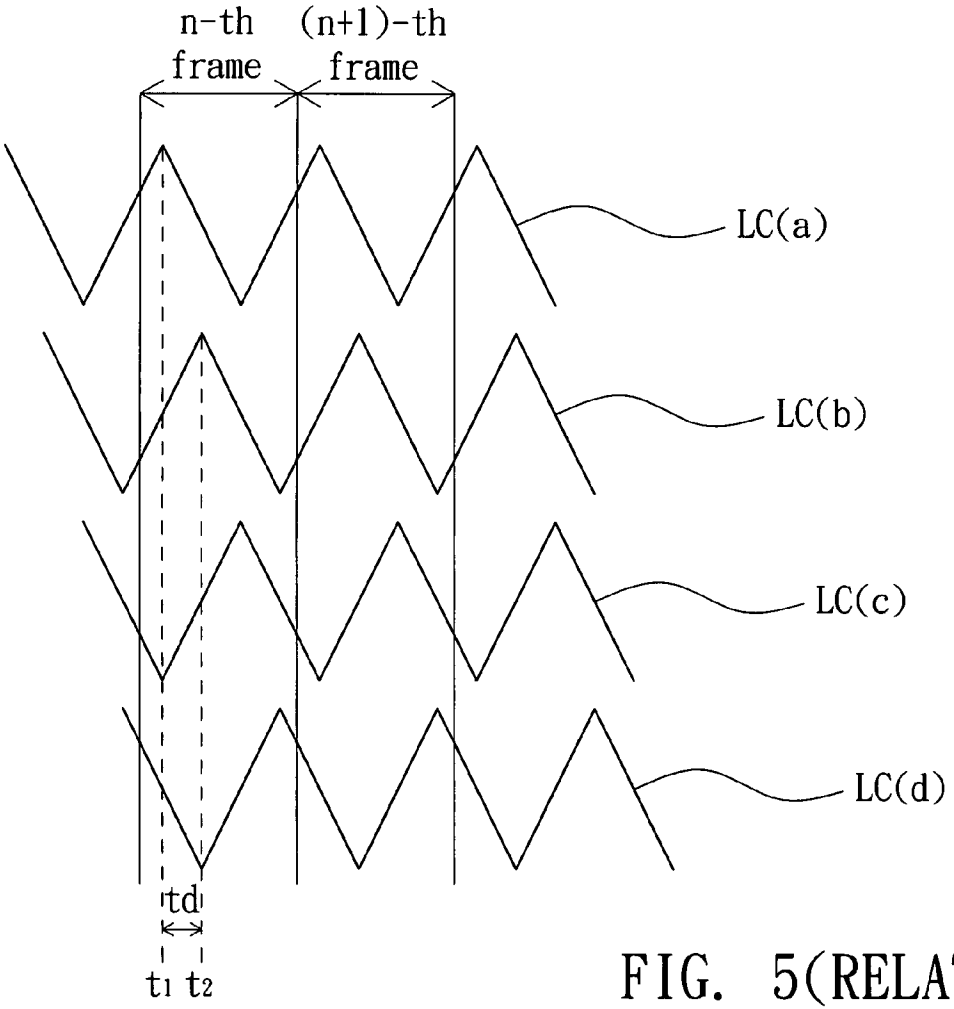
FIG. 5(RELATED ART)
FIG. 5 shows liquid crystal response curves of a liquid crystal display in different horizontal display areas.
Figure 6:
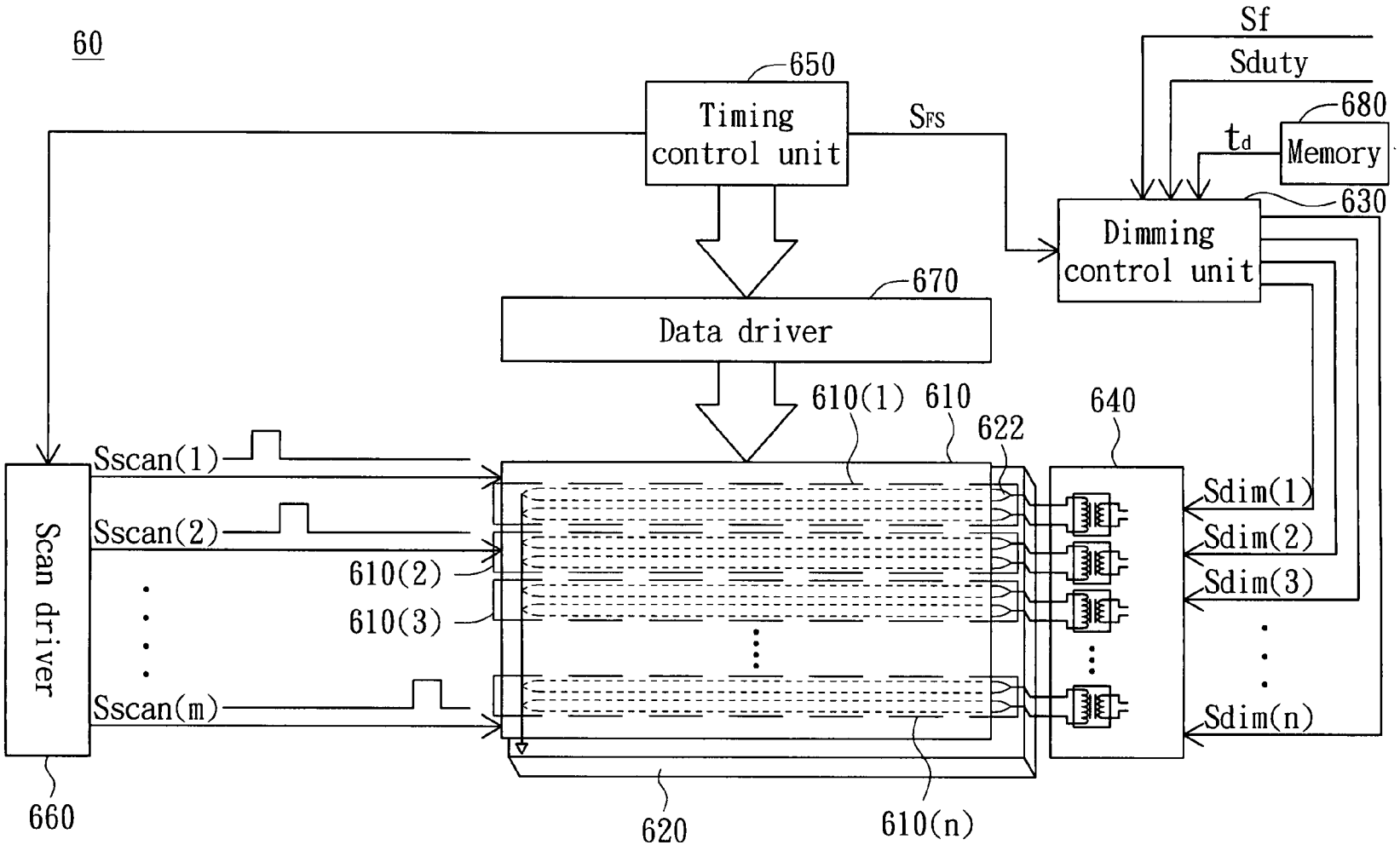
FIG. 6 is a block diagram showing a liquid crystal display according to a preferred embodiment of the invention.

FIG. 6 is a block diagram showing a liquid crystal display 60 according to a preferred embodiment of the invention. Referring to FIG. 6, the liquid crystal display 60 includes a liquid crystal display panel 610, a backlight module 620, a dimming control unit 630 and a backlight module driving circuit 640.

The liquid crystal display panel 610 has multiple horizontal display areas, such as the horizontal display areas 610(1) to 610(n), and each horizontal display area has multiple pixels.

The backlight module 620 includes a plurality of lighting devices 622 respectively corresponding to the pixels in the horizontal display areas 610(1) to 610(n), wherein "n" is a positive integer. For example, the backlight module 620 may be an impulse type backlight module, and the lighting device 622 may be a lighting source such as a cold cathode fluorescent lamp (CCFL), a light emitting diode (LED) or a plasma display.

The dimming control unit 630 generates dimming control signals $S_{dim}$(1) to $S_{dim}$(n) and outputs the dimming control signals $S_{dim}$(1) to $S_{dim}$(n) to the backlight module driving circuit 640. The backlight module driving circuit 640, such as an inverter, receives the dimming control signals $S_{dim}$(1) to $S_{dim}$(n), and periodically drives the lighting devices 622 in sequence according to the dimming control signals $S_{dim}$(1) to $S_{dim}$(n). The driven lighting device 622 corresponds to one of the horizontal display areas 610(1) to 610(n).

When the dimming frequency of the dimming control signals $S_{dim}$(1) to $S_{dim}$(n) is a multiple of the frame rate of the liquid crystal display panel 610 (e.g., when the dimming frequency is 300 Hz and the frame rate is 75 Hz), the frame displayed on the liquid crystal display 60 has no frame flicker. Thus, the liquid crystal display 60 can improve the motion blur of the dynamic frame and further make the user watch the frame more comfortable.

In detail, the liquid crystal display 60 further includes a timing control unit 650, a scan driver 660, a data driver 670 and a memory 680. The timing control unit 650 controls the scan driver 660 and the data driver 670 to drive the liquid crystal display panel 610. The timing control unit 650 controls the scan driver 660 to sequentially output scan signals $S_{scan}$(1) to $S_{scan}$(m) to drive the pixels of each horizontal display area in the liquid crystal display panel 610.

Because the scan signals $S_{scan}$(1) to $S_{scan}$(m) have different timings, liquid crystal delay phases exist between the pixels of different horizontal display areas and the liquid crystal delay phase substantially equals a period of delay time $t_d$, which is stored in the memory 680. The memory 680 may be, for example, an electrically erasable programmable read only memory (EEPROM), a data flash memory or a one time programmable memory (OTP).

The timing control unit 650 controls the scan driver 660 and the data driver 670, and outputs a frame synchronous signal $S_{FS}$ to the dimming control unit 630, which may be a pulse width modulation (PWM) dimming control unit, for example. The dimming control unit 630 outputs the dimming control signals $S_{dim}$(1) to $S_{dim}$(n) according to the frame synchronous signal $S_{FS}$, a periodicity control signal $S_{duty}$, a frequency control signal $S_f$ and the delay time $t_d$ stored in the memory 680.

The periodicity control signal $S_{duty}$ received by the dimming control unit 630 is used to control the duty cycle of the dimming control signals $S_{dim}$(1) to $S_{dim}$(n), and the frequency control signal $S_f$ received by the dimming control unit 630 is used to control the frequency of the dimming control signals $S_{dim}$(1) to $S_{dim}$(n). The dimming control signals $S_{dim}$(1) to $S_{dim}$(n) outputted by the dimming control unit 630 may be burst dimming control signals, for example. The dimming control unit 630 changes the duty cycle of the burst dimming control signal to adjust the luminance of the lighting device 622 according to the periodicity control signal $S_{duty}$.

Figure 7:
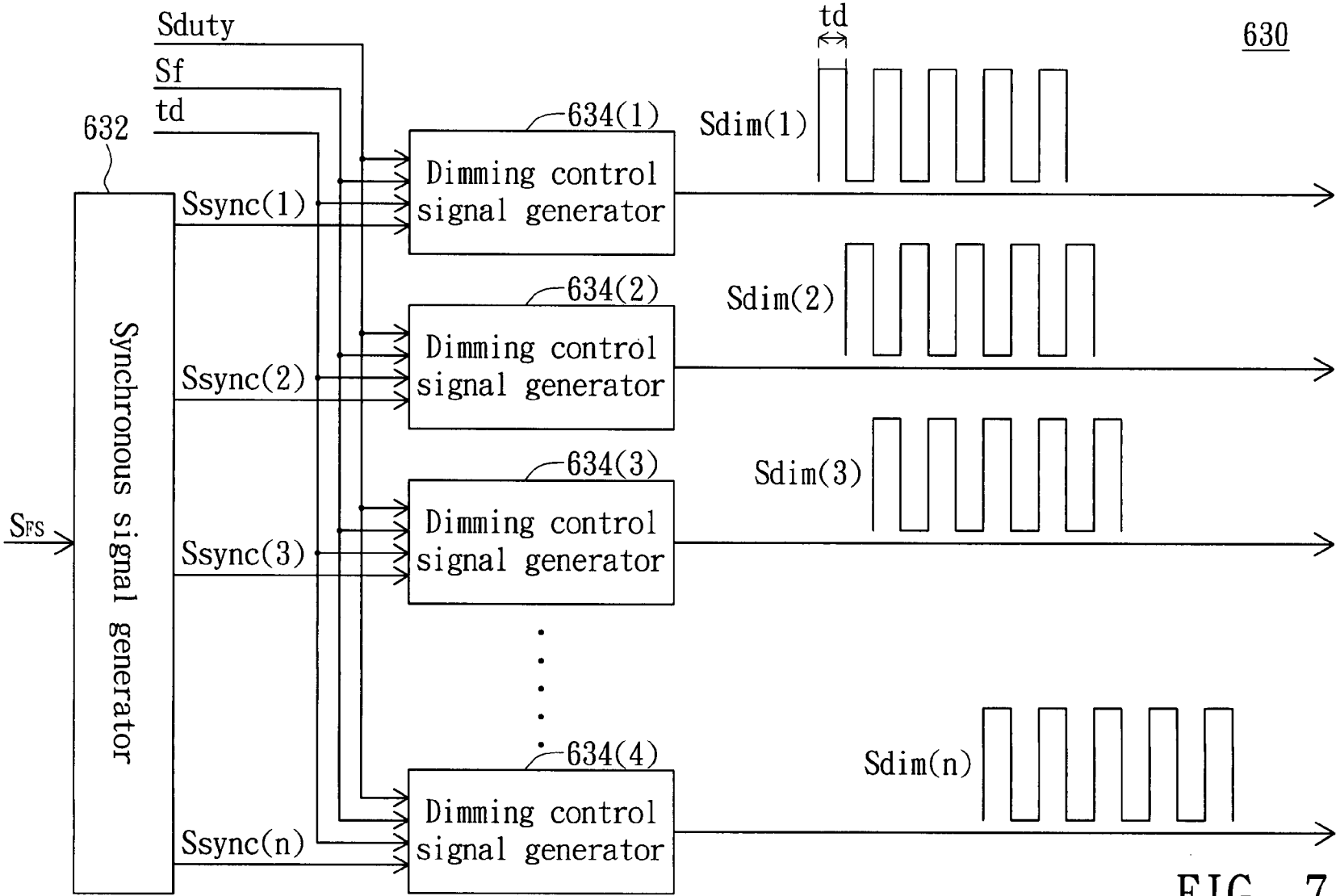
FIG. 7 is a block diagram showing a dimming control unit.

FIG. 7 is a block diagram showing a dimming control unit. In detail, the dimming control unit 630 includes a synchronous signal generator 632 and dimming control signal generators 634(1) to 634(n). The synchronous signal generator 632 receives the frame synchronous signal $S_{FS}$ and outputs synchronous signals $S_{sync}$(1) to $S_{sync}$(n) to the corresponding dimming control signal generators 634(1) to 634(n) according to the frame synchronous signal $S_{FS}$.

The dimming control signal generators 634(1) to 634(n) are PWM dimming control signal generators, for example. The dimming control signal generators 634(1) to 634(n) respectively output the dimming control signals $S_{dim}$(1) to $S_{dim}$(n) to the backlight module driving circuit 640 according to the corresponding synchronous signals $S_{sync}$(1) to $S_{sync}$(n) the periodicity control signal $S_{duty}$, the frequency control signal $S_f$ and the delay time $t_d$ stored in the memory 680.

The dimming control signal generators 634(1) to 634(n) adjust the phases of the dimming control signals $S_{dim}$(1) to $S_{dim}$(n) according to the delay time $t_d$, and the dimming control signals $S_{dim}$(1) to $S_{dim}$(n) are shifted according to the liquid crystal delay phase of each horizontal display area. After the phases of the dimming control signals $S_{dim}$(1) to $S_{dim}$(n) have been delayed and adjusted, a period of delay time $t_d$ exists between adjacent two of the dimming control signals $S_{dim}$(1) to $S_{dim}$(n) such that the phenomenon of the horizontal black band appearing on the frame is improved.

The dimming control signal generators 634(1) to 634(n) output the dimming control signals $S_{dim}$(1) to $S_{dim}$(n) to the backlight module driving circuit 640. When the scan driver 660 drives the pixels in one of the horizontal display areas 610(1) to 610(n), the backlight module driving circuit 640 correspondingly drives the lighting device 622 according to one of the dimming control signals $S_{dim}$(1) to $S_{dim}$(n), wherein the driven lighting device 622 corresponds to the pixels in the horizontal display area that is driven.

For example, when the scan driver 660 drives the pixels in the horizontal display area 610(1), the dimming control signal $S_{dim}$(1) outputted by the dimming control unit 630 drives the lighting device 622 corresponding to the horizontal display area 610(1). When the scan driver 660 drives the pixels in the horizontal display area 610(2), the dimming control signal $S_{dim}$(2) outputted by the dimming control unit 630 drives the lighting device 622 corresponding to the horizontal display area 610(2). The other procedures are performed analogically.

Figure 8:
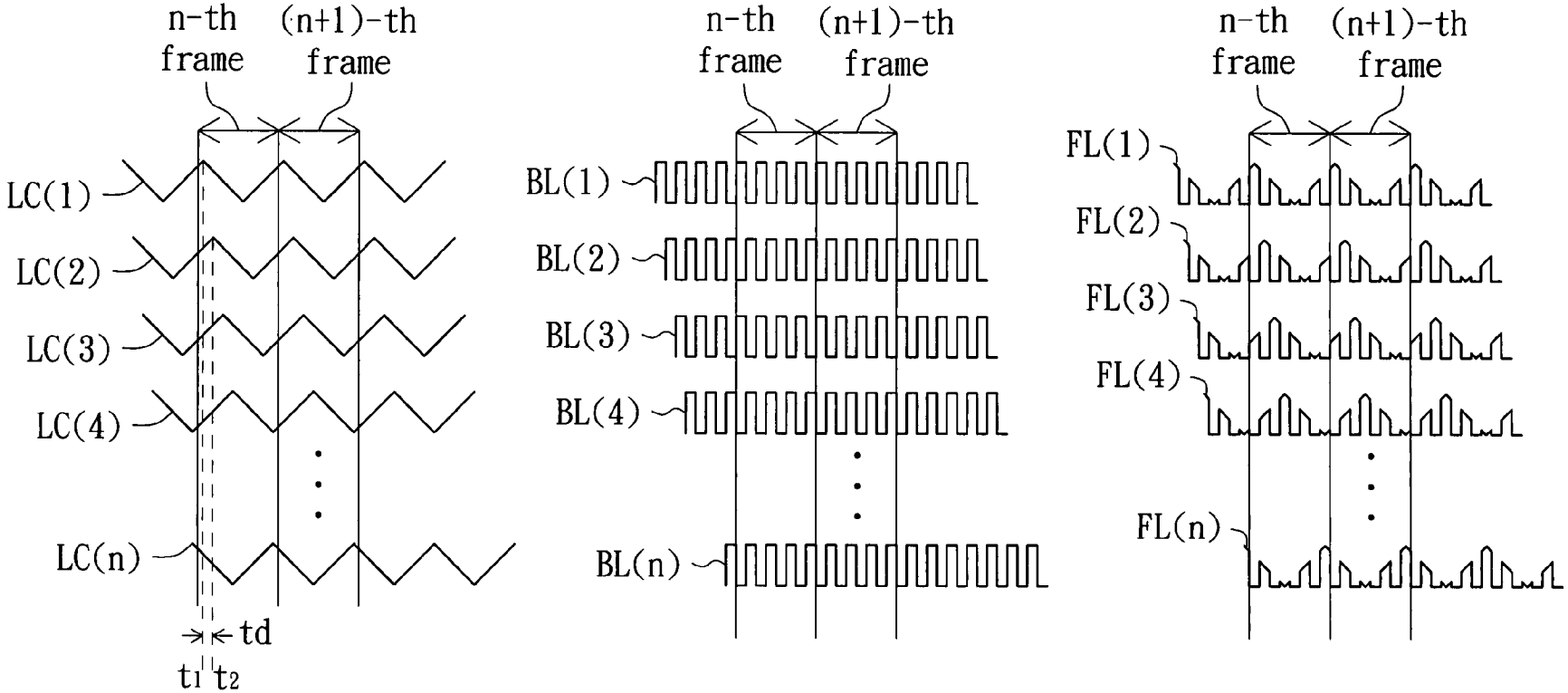
FIG. 8 is a schematic illustration showing waveforms of a liquid crystal response curve, a backlight luminance curve and a frame luminance curve in the liquid crystal display.

FIG. 8 is a schematic illustration showing waveforms of a liquid crystal response curve, a backlight luminance curve and a frame luminance curve in the liquid crystal display. The transmissions of the liquid crystal molecules in the horizontal display areas 610(1) to 610(n) form liquid crystal response curves LC(1) to LC(n) with the time. For example, the liquid crystal response curve in the horizontal display area 610(1) is the liquid crystal response curve LC(1), and the liquid crystal response curve of the horizontal display area 610(2) is the liquid crystal response curve LC(2). Because the scan signal $S_{scan}$(1) to $S_{scan}$(m) have different timings, the liquid crystal delay phases, which substantially equal the delay time $t_d$, exist between the liquid crystal response curves LC(1) to LC(n).

For example, the liquid crystal molecules in the horizontal display area 610(1) reach the maximum transmission at time t1, and the liquid crystal molecules in the horizontal display area 610(2) reach the maximum transmission at time t2. In other words, the liquid crystal molecules in the horizontal display area 610(2) cannot reach the maximum transmission until a period of delay time $t_d$ has elapsed after the liquid crystal molecules of the horizontal display area 610(1) reach the maximum transmission, wherein $t_d$=t2−t1.

The backlight luminance of the backlight module 620 forms corresponding backlight luminance curves BL(1) to BL(n) with the time, respectively, and the backlight luminance curves BL(1) to BL(n) respectively correspond to the horizontal display areas. For example, the backlight luminance curve BL(1) corresponds to the horizontal display area 610(1), and the backlight luminance curve BL(2) corresponds to the horizontal display area 610(2).

In addition, the frame luminance represented by the liquid crystal display panel 610 depends on the backlight luminance formed by the backlight module 620 and the orientations of the liquid crystal molecules. So, the frame luminance of the liquid crystal display panel 610 forms frame luminance curves FL(1) to FL(n) with the time, respectively. The frame luminance curves FL(1) to FL(n) respectively correspond to the horizontal display areas. For example, the frame luminance curve FL(1) corresponds to the horizontal display area 610(1), and the frame luminance curve FL(2) corresponds to the horizontal display area 610(2).

Because the dimming control signals $S_{dim}$(1) to $S_{dim}$(n) outputted by the dimming control unit 630 are correspondingly adjusted with the liquid crystal delay phase, the waveforms of the luminance pulses in the frame luminance curves FL(1) to FL(n) are substantially the same. Thus, the frames displayed by the liquid crystal display 60 have the uniformity, the phenomenon of slow movement of the horizontal black band is improved, and the frame quality of the liquid crystal display 60 is enhanced.

In addition, because the dimming control signals $S_{dim}$(1) to $S_{dim}$(n) outputted by the dimming control unit 630 are correspondingly adjusted with the liquid crystal delay phase, the liquid crystal display 60 cannot generate the frame flicker phenomenon and can ensure the stable frame quality even if the frame rate inputted by the client has a jitter (e.g., 75 Hz±1% or 60 Hz±3%).

Figure 9:
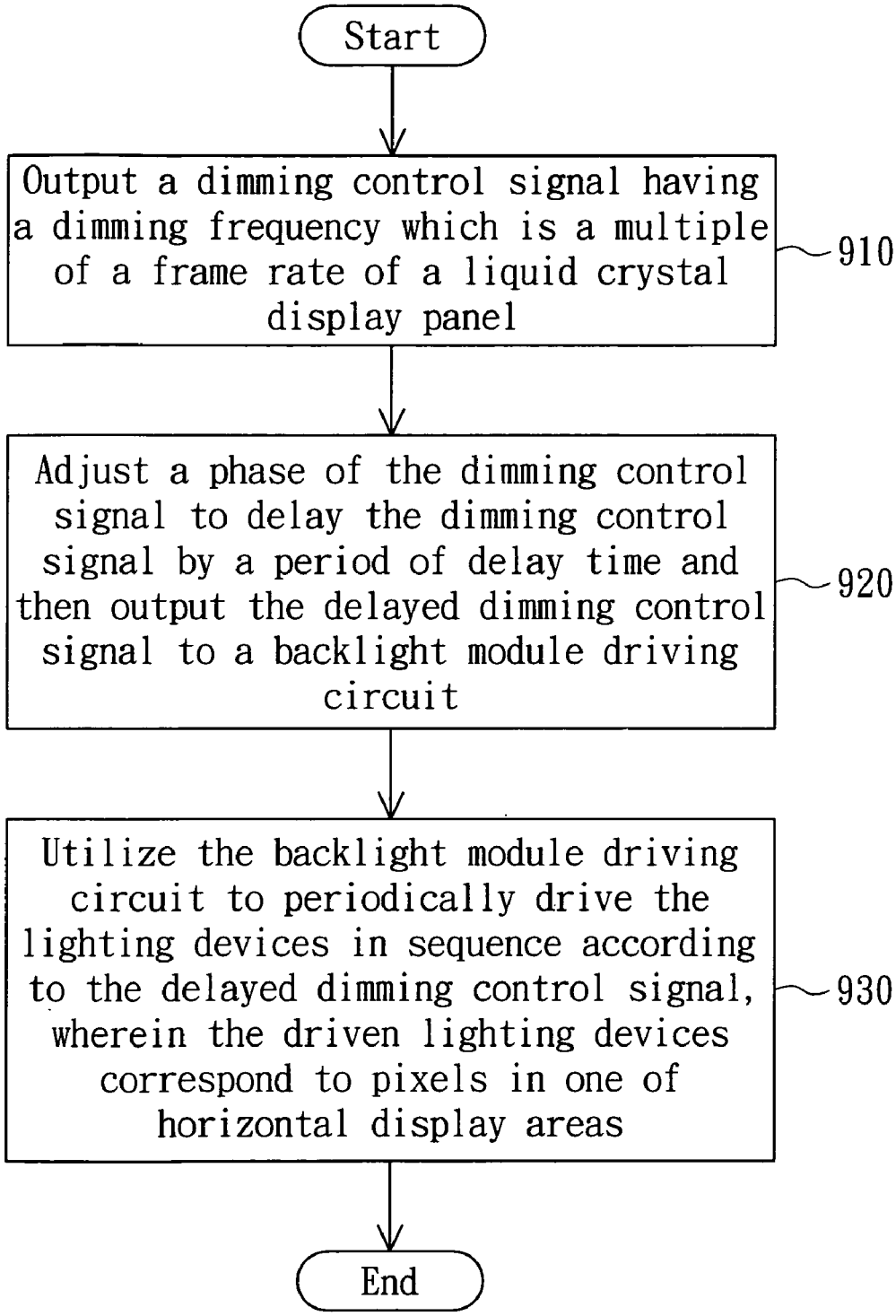
FIG. 9 is a flow chart showing a driving method for a liquid crystal display according to a preferred embodiment of the invention.

FIG. 9 is a flow chart showing a driving method for a liquid crystal display according to a preferred embodiment of the invention. The driving method for the liquid crystal display 60 includes the following steps. First, as shown in step 910, the dimming control unit 630 outputs the dimming control signals $S_{dim}$(1) to $S_{dim}$(n) having a dimming frequency which is a multiple of the frame rate of the liquid crystal display panel 610. Next, as shown in step 920, the phases of the dimming control signals $S_{dim}$(1) to $S_{dim}$(n) are adjusted such that the dimming control signals $S_{dim}$(1) to $S_{dim}$(n) are delayed by a period of delay time $t_d$ and then outputted to the backlight module driving circuit 640. Finally, as shown in step 930, the backlight module driving circuit 640 periodically drives the lighting devices 622 in sequence according to the delayed dimming control signals $S_{dim}$(1) to $S_{dim}$(n), wherein the driven lighting device 622 corresponds to the pixels in one of the horizontal display areas 610(1) to 610(n).

In the liquid crystal display and the driving method thereof according to the embodiments of the invention, the dimming frequency of the dimming control signal is adjusted to be a multiple of the frame rate of the liquid crystal display panel, and the phase of the dimming control signal is adjusted according to the liquid crystal delay phases of different horizontal display areas. Thus, the invention has the following advantages.

The first advantage is that the frame flicker phenomenon is improved. Because the dimming frequency of the dimming control signal outputted by the dimming control unit is a multiple of the frame rate of the liquid crystal display panel, the frame displayed on the liquid crystal display has no frame flicker phenomenon, and the user may watch the frames in a more comfortable manner.

The second advantage is that the slow movement phenomenon of the horizontal black band is improved. The phase of the dimming control signal outputted by the dimming control unit is adjusted according to the liquid crystal delay phases of different horizontal display areas. So, the frame displayed by the liquid crystal display has no phenomenon of the slow movement of the horizontal black band, and the frame quality of the liquid crystal display is thus enhanced.

The third advantage is that the frame flicker phenomenon caused by the jitter of the frame rate inputted by the client is avoided. Because the phase of the dimming control signal outputted by the dimming control unit is adjusted according to the liquid crystal delay phases of different horizontal display areas, the liquid crystal display has no frame flicker phenomenon even if the frame rate inputted by the client has the jitter.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A liquid crystal display, comprising:

a liquid crystal display panel having a plurality of liquid crystal molecules and a plurality of horizontal display areas, each of the horizontal display areas including a plurality of pixels in a row;

a backlight module, comprising a plurality of linear lighting devices respectively corresponding to the pixels in each of the horizontal display areas;

a dimming control unit for generating a plurality of dimming control signals, each of the dimming control signals having a dimming frequency, the dimming frequency of each of the dimming control signals being higher than a frame rate of the liquid crystal display panel and the dimming frequency of each of the dimming control signals being a multiple of the frame rate, wherein the dimming control unit adjusts a phase of each of the dimming control signals such that each of the dimming control signals is delayed by a period of delay time one by one;

a backlight module driving circuit for periodically driving the linear lighting devices in sequence according to the plurality of dimming control signals, and a scan driver for outputting a scan signal such that the liquid crystal molecules of the pixels in each of the horizontal display areas reach a maximum transmission at a maximum time, and a difference between each maximum time of each horizontal display area equals the delay time.

2. The liquid crystal display according to claim 1, further comprising a memory for storing the delay time.

3. The liquid crystal display according to claim 2, further comprising a timing control unit for outputting a frame synchronous signal, wherein the dimming control unit outputs the plurality of dimming control signals according to the frame synchronous signal, a periodicity control signal, a frequency control signal and the delay time.

4. The liquid crystal display according to claim 3, wherein the dimming control unit comprises:

a synchronous signal generator for receiving the frame synchronous signal and thus outputting a plurality of synchronous signals; and a plurality of dimming control signal generators for generating a plurality of dimming control signals and outputting the dimming control signals to the backlight module driving circuit according to the synchronous signals, the periodicity control signal and the delay time.

5. The liquid crystal display according to claim 4, wherein the dimming control unit is a pulse width modulation (PWM) dimming control unit, and each of the dimming control signal generators is a PWM dimming control signal generator.

6. The liquid crystal display according to claim 1, wherein the linear lighting devices comprise cold cathode fluorescent lamps (CCFL) or light emitting diodes (LED).

7. The liquid crystal display according to claim 1, wherein the linear lighting devices comprise plasma displays.

8. The liquid crystal display according to claim 1, wherein the backlight module driving circuit comprises an inverter.

9. The liquid crystal display according to claim 1, wherein the plurality of dimming control signals are burst dimming control signals, and the dimming control unit changes a duty cycle of each of the burst dimming control signals to adjust luminance of each of the linear lighting devices.

10. A driving method adopted in a liquid crystal display comprising a liquid crystal display panel, a backlight module driving circuit and a backlight module, the liquid crystal display panel having a plurality of liquid crystal molecules and a plurality of horizontal display areas, each of the horizontal display areas including a plurality of pixels in a row, the backlight module comprising a plurality of linear lighting devices, the driving method comprising the steps of:

utilizing a dimming control unit to output a plurality of dimming control signals, each of the dimming control signals having a dimming frequency, the dimming frequency of each of the dimming control signals being higher than a frame rate of the liquid crystal display panel and the dimming frequency of each of the dimming control signals being a multiple of the frame rate;

adjusting a phase of each of the dimming control signals to delay each of the dimming control signals by a period of delay time one by one, and then outputting the delayed dimming control signals to the backlight module driving circuit;

utilizing the backlight module driving circuit to periodically drive the linear lighting devices in sequence according to the delayed dimming control signals, wherein a part of the driven linear lighting devices corresponds to the pixels in the horizontal display areas, and outputting a scan signal such that the liquid crystal molecules of the pixels in each of the horizontal display areas reach a maximum transmission at a maximum time, and a difference between each maximum time of each horizontal display area equals the delay time.

11. The method according to claim 10, wherein the liquid crystal display further comprises a memory for storing the delay time.

12. The method according to claim 10, wherein the liquid crystal display further comprises a timing control unit for outputting a frame synchronous signal, wherein the dimming control unit outputs the plurality of dimming control signals according to the frame synchronous signal, a periodicity control signal, a frequency control signal and the delay time.

13. The method according to claim 12, wherein the dimming control unit comprises:

a synchronous signal generator for receiving the frame synchronous signal and thus outputting a plurality of synchronous signals; and a plurality of dimming control signal generators for generating a plurality of dimming control signals and outputting the dimming control signals to the back light module driving circuit according to the synchronous signals, the periodicity control signal, the frequency control signal and the delay time.

14. The method according to claim 13, wherein the dimming control unit is a pulse width modulation (PWM) dimming control unit, and each of the dimming control signal generators is a PWM dimming control signal generator.

15. The method according to claim 10, wherein the linear lighting devices comprise cold cathode fluorescent lamps (CCFL) or light emitting diodes (LED).

16. The method according to claim 10, wherein the linear lighting devices comprise plasma displays.

17. The method according to claim 10, wherein the backlight module driving circuit comprises an inverter.

18. The method according to claim 10, wherein the plurality of dimming control signals are burst dimming control signals, and the dimming control unit changes a duty cycle of each of the burst dimming control signals to adjust luminance of each of the linear lighting devices.

19. A liquid crystal display, comprising:

a liquid crystal display panel having a plurality of liquid crystal molecules and a plurality of horizontal display areas, each of the horizontal display areas including a plurality of pixels in a row;

a backlight module, comprising a plurality of linear lighting devices respectively corresponding to the pixels in each of the horizontal display areas;

a dimming control unit for generating a plurality of dimming control signals, each of the dimming control signals having a dimming frequency, the dimming frequency of each of the dimming control signals being equal to F multiplied by a frame rate of the liquid crystal display panel and F being a positive integer larger than one, wherein the dimming control unit adjusts a phase of each of the dimming control signals such that each of the dimming control signals is delayed by a period of delay time one by one;

a backlight module driving circuit for periodically driving the linear lighting devices in sequence according to the plurality of dimming control signals; and a scan driver for outputting a scan signal such that the liquid crystal molecules of the pixels in each of the horizontal display areas reach a maximum transmission at a maximum time, and a difference between each maximum time of each horizontal display area equals the delay time.

* * * * *